US007219502B2

(12) United States Patent
Nierenberg

(10) Patent No.: US 7,219,502 B2
(45) Date of Patent: May 22, 2007

(54) SHIPBOARD REGASIFICATION FOR LNG CARRIERS WITH ALTERNATE PROPULSION PLANTS

(75) Inventor: Alan Nierenberg, Tampa, FL (US)

(73) Assignee: Excelerate Energy Limited Partnership, The Woodlands, TX (US)

( * ) Notice: Subject to any disclaimer, the term of this patent is extended or adjusted under 35 U.S.C. 154(b) by 368 days.

(21) Appl. No.: 10/916,625

(22) Filed: Aug. 12, 2004

(65) Prior Publication Data

US 2005/0061002 A1 Mar. 24, 2005

Related U.S. Application Data

(60) Provisional application No. 60/494,092, filed on Aug. 12, 2003.

(51) Int. Cl.
*F17C 9/02* (2006.01)

(52) U.S. Cl. ..... 62/50.2

(58) Field of Classification Search ..... 62/50.2
See application file for complete search history.

(56) References Cited

U.S. PATENT DOCUMENTS

| | | | | |
|---|---|---|---|---|
| 2,795,937 | A | 6/1957 | Sattler et al. | |
| 2,938,359 | A | 5/1960 | Cobb, Jr. et al. | |
| 2,940,268 | A | 6/1960 | Morrsion | |
| 2,975,607 | A | 3/1961 | Bodie | |
| 3,034,309 | A | 5/1962 | Muck | |
| 3,197,972 | A | 8/1965 | King | |
| 3,350,876 | A * | 11/1967 | Johnson | 60/618 |
| 3,365,898 | A | 1/1968 | Van Kleef | |
| 3,438,216 | A | 4/1969 | Smith | |
| 3,535,885 | A | 10/1970 | Frijlink et al. | |
| 3,561,524 | A | 2/1971 | Satterthwaite et al. | |
| 3,724,229 | A | 4/1973 | Seliber | |
| 3,755,142 | A | 8/1973 | Whipple, Jr. | |

(Continued)

FOREIGN PATENT DOCUMENTS

DE 3225299 1/1984

(Continued)

OTHER PUBLICATIONS

SR01 International Search Report for PCT Application No. PCT/US02/05923, mailed Jun. 7, 2002, 1 page.

(Continued)

*Primary Examiner*—William C. Doerrler
(74) *Attorney, Agent, or Firm*—Meyertons, Hood, Kivlin, Kowert & Goetzel, P.C.; Eric B. Meyertons

(57) ABSTRACT

A liquefied natural gas carrier uses a diesel engine or gas turbine propulsion plant fitted with a shipboard regasification system. The propulsion plant can provide either a direct mechanical drive of the propeller shaft and propeller, or can be fitted with an integrated electric power plant using an electric motor or motors to drive the propeller shaft and propeller. The regasification system includes a heat input source of exhaust gas heat exchangers, electric water heaters and supplemental heaters to provide an additional heat source to a hot water circulating loop. The liquefied natural gas contacts the hot water or heating medium circulating loop and is regasified. An undersea conduit from the ship transmits the regasified natural gas to an on shore plant.

21 Claims, 5 Drawing Sheets

U.S. PATENT DOCUMENTS

| | | | | | |
|---|---|---|---|---|---|
| 3,850,001 | A | | 11/1974 | Locke | |
| 3,897,754 | A | | 8/1975 | Jerde | |
| 3,978,663 | A | | 9/1976 | Mandrin et al. | |
| 4,033,135 | A | | 7/1977 | Mandrin | |
| 4,036,028 | A | | 7/1977 | Mandrin | |
| 4,041,721 | A | | 8/1977 | Kniel | |
| 4,170,115 | A | | 10/1979 | Ooka et al. | |
| 4,219,725 | A | | 8/1980 | Groninger | |
| 4,224,802 | A | | 9/1980 | Ooka | |
| 4,231,226 | A | * | 11/1980 | Griepentrog | 60/648 |
| 4,255,646 | A | | 3/1981 | Dragoy et al. | |
| 4,292,062 | A | | 9/1981 | Dinulescu et al. | |
| 4,315,407 | A | | 2/1982 | Creed et al. | |
| 4,329,842 | A | | 5/1982 | Hoskinson et al. | |
| 4,331,129 | A | | 5/1982 | Hong et al. | |
| 4,338,993 | A | | 7/1982 | Fernstrum | |
| 4,417,878 | A | | 11/1983 | Koren | |
| 4,429,536 | A | | 2/1984 | Nozawa | |
| 4,519,213 | A | * | 5/1985 | Brigham et al. | 62/50.2 |
| 4,693,304 | A | | 9/1987 | Volland | |
| 4,716,737 | A | | 1/1988 | Mandrin | |
| 4,819,454 | A | | 4/1989 | Brigham | |
| 4,881,495 | A | * | 11/1989 | Tornare et al. | 123/41.31 |
| 4,924,822 | A | | 5/1990 | Asai et al. | |
| 5,375,580 | A | | 12/1994 | Stolz et al. | |
| 5,400,588 | A | | 3/1995 | Yamane et al. | |
| 5,457,951 | A | | 10/1995 | Johnson et al. | |
| 5,711,270 | A | | 1/1998 | Pedersen | |
| 5,762,119 | A | | 6/1998 | Platz et al. | |
| 6,079,222 | A | | 6/2000 | Fetescu et al. | |
| 6,089,022 | A | | 7/2000 | Zednik et al. | |
| 6,116,031 | A | | 9/2000 | Minta et al. | |
| 6,164,247 | A | | 12/2000 | Iwasaki et al. | |
| 6,298,671 | B1 | | 10/2001 | Kennelley et al. | |
| 6,336,316 | B1 | | 1/2002 | Fujii et al. | |
| 6,367,258 | B1 | * | 4/2002 | Wen et al. | 60/641.7 |
| 6,374,591 | B1 | | 4/2002 | Johnson et al. | |
| 6,519,944 | B2 | | 2/2003 | Smith | |
| 6,578,366 | B1 | | 6/2003 | Christiansen et al. | |
| 6,598,408 | B1 | | 7/2003 | Nierenberg | |
| 6,644,041 | B1 | * | 11/2003 | Eyermann | 62/50.2 |
| 6,688,114 | B2 | | 2/2004 | Nierenberg | |
| 6,832,875 | B2 | | 12/2004 | Bliault et al. | |
| 2002/0073619 | A1 | | 6/2002 | Perkins et al. | |
| 2002/0186966 | A1 | * | 12/2002 | Zimmer et al. | 392/397 |
| 2005/0061002 | A1 | | 3/2005 | Nierenberg | |

FOREIGN PATENT DOCUMENTS

| | | | | |
|---|---|---|---|---|
| EP | 0048316 | | | 6/2006 |
| GB | 2007823 | A | * | 5/1979 |
| JP | 52010910 | | | 1/1977 |
| JP | 52010911 | | | 1/1977 |
| JP | 53115666 | | | 10/1978 |
| JP | 53126003 | | | 11/1978 |
| JP | 54022404 | | | 2/1979 |
| JP | 54136413 | | | 10/1979 |
| JP | 54136414 | | | 10/1979 |
| JP | 56015801 | | | 2/1981 |
| JP | 56074190 | | | 6/1981 |
| JP | 58005598 | | | 1/1983 |
| JP | 59166799 | | | 9/1984 |
| JP | 61038300 | | | 2/1986 |
| JP | 62141398 | | | 6/1987 |
| JP | 64069898 | | | 3/1989 |
| JP | 05332499 | | | 12/1993 |
| JP | 11125397 | | | 5/1995 |
| JP | 09014869 | | | 1/1997 |
| JP | 11148599 | | | 6/1999 |
| JP | 2001263592 | | | 9/2001 |
| WO | 99/47869 | | | 9/1999 |

OTHER PUBLICATIONS

SR02 International Search Report for PCT Application No. PCT/US02/09902, mailed Sep. 2, 2002 1 page.

SR03 International Search Report for PCT Application No. PCT/US02/09901, mailed Sep. 12, 2002 1 page.

SR04 International Search International Search Report for PCT Application No. PCT/US2004/026293, mailed Jan. 25, 2006 1 page.

SR05 European Patent Office Search Report for EP Application No. 02707906.0, Mar. 21, 2006, 3 pages.

SR06 European Patent Office Search Report for EP Application No. 02715238.8, Mar. 21, 2006, 3 pages.

OA01 USPTO "Office Communication" for U.S. Appl. No. 10/083,920 mailed Jan. 3, 2005, 5 pages, available in Public PAIR.

OA02 USPTO"Office Communication" for U.S. Appl. No. 10/083,920 mailed Jan. 2, 2004, 5 pages, available in Public PAIR.

OA06 USPTO "Office Communication" for U.S. Appl. No. 10/083,920 mailed Jul. 5, 2005, 4 pages, available in Public PAIR.

OA03 Canadian Office of Intellectual Property Communication, Jan. 20, 2006, 2 pages.

OA04 People Republic of China "Notice of First Office Action", Mar. 3, 2006, 9 pages.

OA05 People Republic of China "Notice of First Office Action", Feb. 17, 2006, 9 pages.

* cited by examiner

SHIPBOARD REGASIFICATION FOR LNG CARRIERS WITH ALTERNATE PROPULSION PLANTS

REFERENCE TO RELATED APPLICATIONS

This application claims priority of U.S. Provisional Patent Application Ser. No. 60/494,092, filed on Aug. 12, 2003, the contents of which are hereby incorporated by reference.

BACKGROUND OF THE INVENTION

1. Field of the Invention

The invention relates to a method and apparatus for shipboard regasification of liquefied natural gas on liquefied natural gas ("LNG") carriers, not fitted with steam propulsion plants. In particular, this invention relates to using the thermal energy of a propulsion system for a LNG carrier, such as a diesel engine or gas turbine propulsion plant which ordinarily drives the propeller shaft and propeller of a ship, to serve an additional function of providing heat to a shipboard regasification system.

2. Description of the Related Art

Conventional steam propulsion plants of sea-going vessels often have two main boilers providing high pressure superheated steam to cross compound steam turbines driving a single shaft line and propeller through double reduction gears. Many of these vessels are liquefied natural gas carriers. Steam has been a popular choice for propulsion plants for liquefied natural gas carriers, primarily due to the ease of burning the boil-off gas from the LNG cargo containment system. When the conventional steam propelled LNG carrier is fitted with regasification equipment, the main steam boilers of the conventional steam propulsion plant served, to provide both high-pressure superheated steam to drive a propeller and propeller shaft of the liquefied natural gas carrier vessels as well as a natural source of heat for regasification of liquid natural gas. Heat from the vessel's steam propulsion plant acts as a primary heat source, with an upgrade in the output of the boilers to match the desired regasified liquid natural gas sendout rate.

Although the steam propulsion plant provides a natural source of heat for shipboard regasification and a simple method for burning of boil-off gas, it is very inefficient thermal cycle for propelling a ship, as compared to modern diesel engines or advanced gas turbine cycles. By contrast, the diesel or gas turbine engines do not provide a comparable amount of available thermal energy to satisfy shipboard regasification, which requires significant heat to gasify the liquefied natural gas prior to its discharge to the shore.

Because of the inefficiency of steam turbine propulsion plants and the current trend to alternate propulsion plants for LNG carriers, the present invention has been developed to use a more efficient propulsion plant such as a diesel engine or gas turbine. The more efficient diesel engine and gas turbine propulsion plants will either provide direct mechanical drive of the propeller and propeller shaft or will be fitted with an integrated electric power plant. However, this alternative propulsion arrangement eliminates the vessel's main steam boilers, which also served as the natural heat source for shipboard regasification. Therefore, there is a need to overcome the lack of a readily available heat source for shipboard regasification in diesel engine and gas turbine propulsion plants.

SUMMARY OF THE INVENTION

The present invention provides a method and apparatus for shipboard regasification that uses propulsion plants other than steam. These alternative propulsion plants include diesel engine and gas turbine propulsion systems that propel a liquefied natural gas carrier by either direct mechanical drive or an integrated electric drive system. The diesel engine(s) and gas turbine engine(s) act as prime movers for the LNG vessel propulsion plant. Since the diesel engines and gas turbines do not provide a readily available natural or sufficient quantity source of heat for shipboard regasification in vessels fitted with an integrated electric power plant, an alternative heating arrangement has been developed. The electric heating arrangement will enable a shipboard regasification system to be fitted to liquid natural gas carriers that have diesel engine or gas turbine propulsion plants, while still obtaining the economic benefits of the diesel engine or gas turbine propulsion plant.

The present invention provides a shipboard regasification system, including hot water heated shell and tube vaporizing unit(s) for vaporizing liquefied gas onboard the LNG vessel. A specially arranged heat-generating propulsion and auxiliary plant on the ship provides a source of heat to the vaporizing unit. The heat input sources for hot water heating system include electric water heaters using the excess electric generating capacity of the LNG's propulsion plant when in a regasification mode and connected to the receiving terminal, exhaust gas heat exchangers fitted to the combustion exhausts of the diesel engines and gas turbines, and natural gas fired hot water or thermal oil heaters. The heat necessary for the shipboard regasification process is generated from the above mentioned heat sources, transferred through heat exchangers into the heating water loop, circulated through a hot water circulating loop to the vaporizers, and provides the necessary heat to a heat exchanger or a gas vaporizer for regasifying liquefied natural gas. The liquefied natural gas is transported and stored on the ship in the conventional LNG cargo tanks and fitted with proven cargo containment systems. An onboard piping and high pressure system can convey the liquefied natural gas from the cargo tanks to the vaporizer(s) or heat exchanger(s). The liquefied natural gas can then be regasified in the vaporizer(s) or heat exchanger(s) by the hot water heating system. In its gasified state, the natural gas can be piped through an undersea piping arrangement from the ship to a remote or on shore plant where it can be subsequently processed or distributed.

BRIEF DESCRIPTION OF THE DRAWINGS

For desired understanding of the invention, reference should be made to the accompanying drawings, wherein.

DETAILED DESCRIPTION OF THE INVENTION

Figure 1:
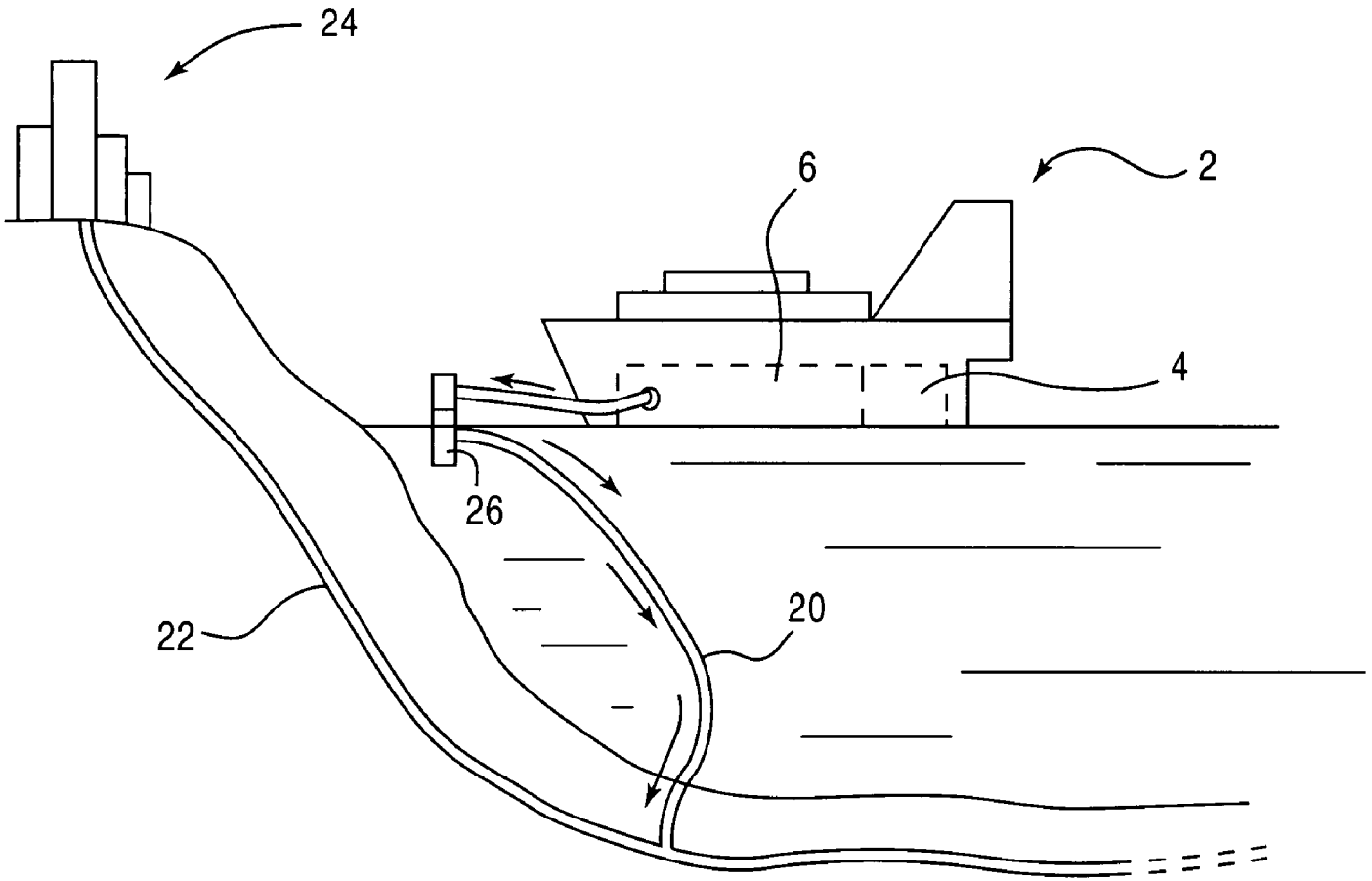
FIG. 1 illustrates a liquefied natural gas carrier according to the present invention.

The present invention is directed to an apparatus and method for creating the thermal heat for shipboard regasification. Referring to FIG. 1, liquefied natural gas carrier or ship 2 has a propulsion system for motive power, and a shipboard regasification system 6. The regasification system 6 uses heat to regasify liquefied natural gas on board the ship. Natural gas in its gaseous state is voluminous, but in a liquefied state occupies considerably less space. Natural gas is typically stored at about −255 to −265° F. in order to be held in the liquid state. Regasification occurs as the liquefied natural gas is reheated.

Generally, shipboard regasification can be performed when the ship is anchored to a mooring buoy 26 or other terminal, at which time the propulsion system is not in use for the movement of the ship. The propulsion system can still be used to provide electricity to other ship components and systems. Therefore, surplus heat or energy generated by a propulsion plant 4, with the addition of heating water systems defined by this invention, can be used to supply the necessary heat to the regasification system 6. For example, when the vessel is anchored to a mooring buoy or other terminal, and not providing motive power, the available thermal energy of the propulsion plant can be captured and converted as heat energy for regasification of the liquefied natural gas. Once regasified, the natural gas can be transmitted from the ship by a conduit 20 to an undersea piping system 22 and to an onshore plant 24 for subsequent processing or distribution. Piping system 22 can be submerged where practical. Conduit 20 can be connected to ship 2 through buoy 26.

Figure 2:
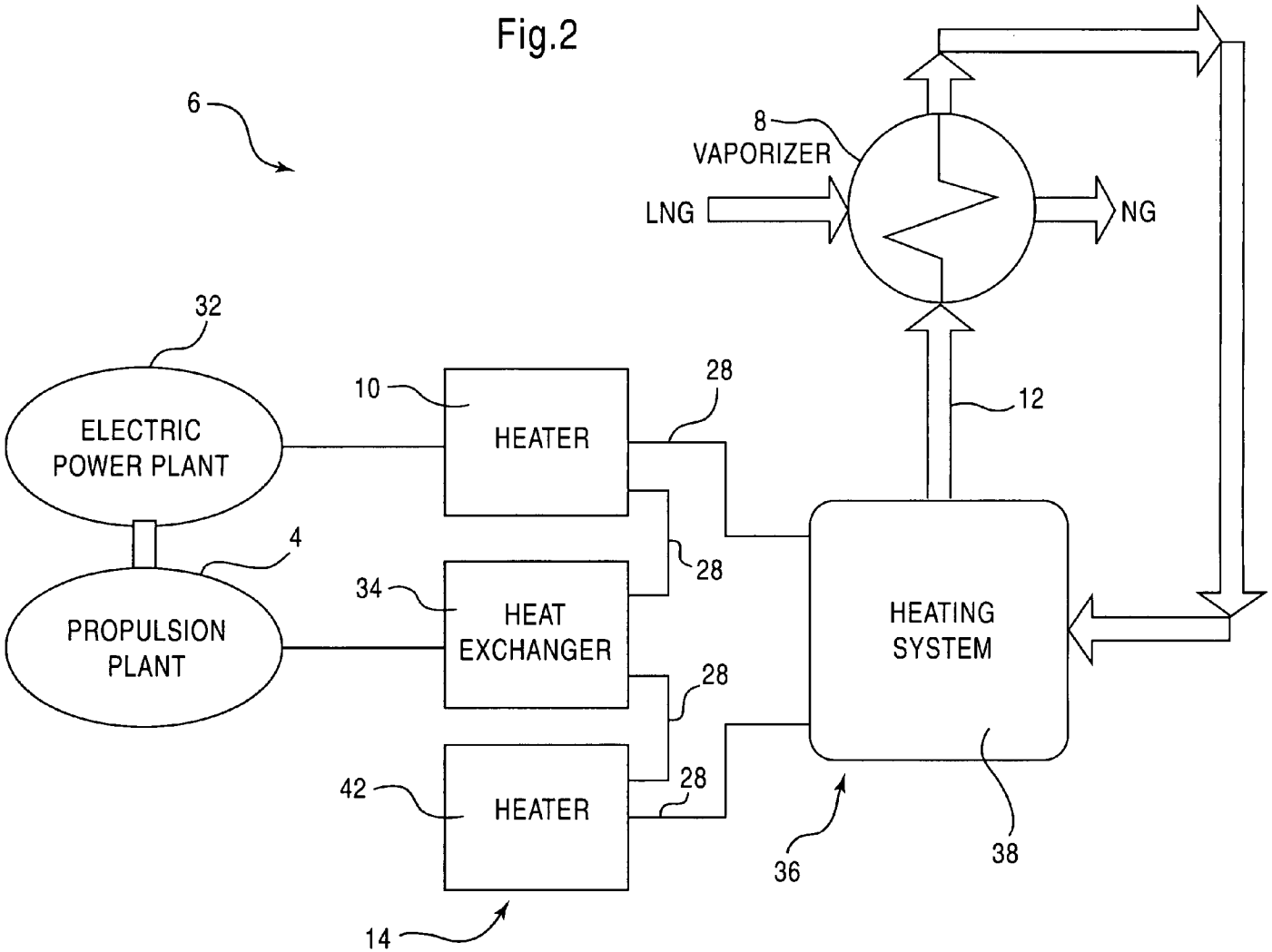
FIG. 2 illustrates a shipboard regasification system according to the present invention.
Figure 5:
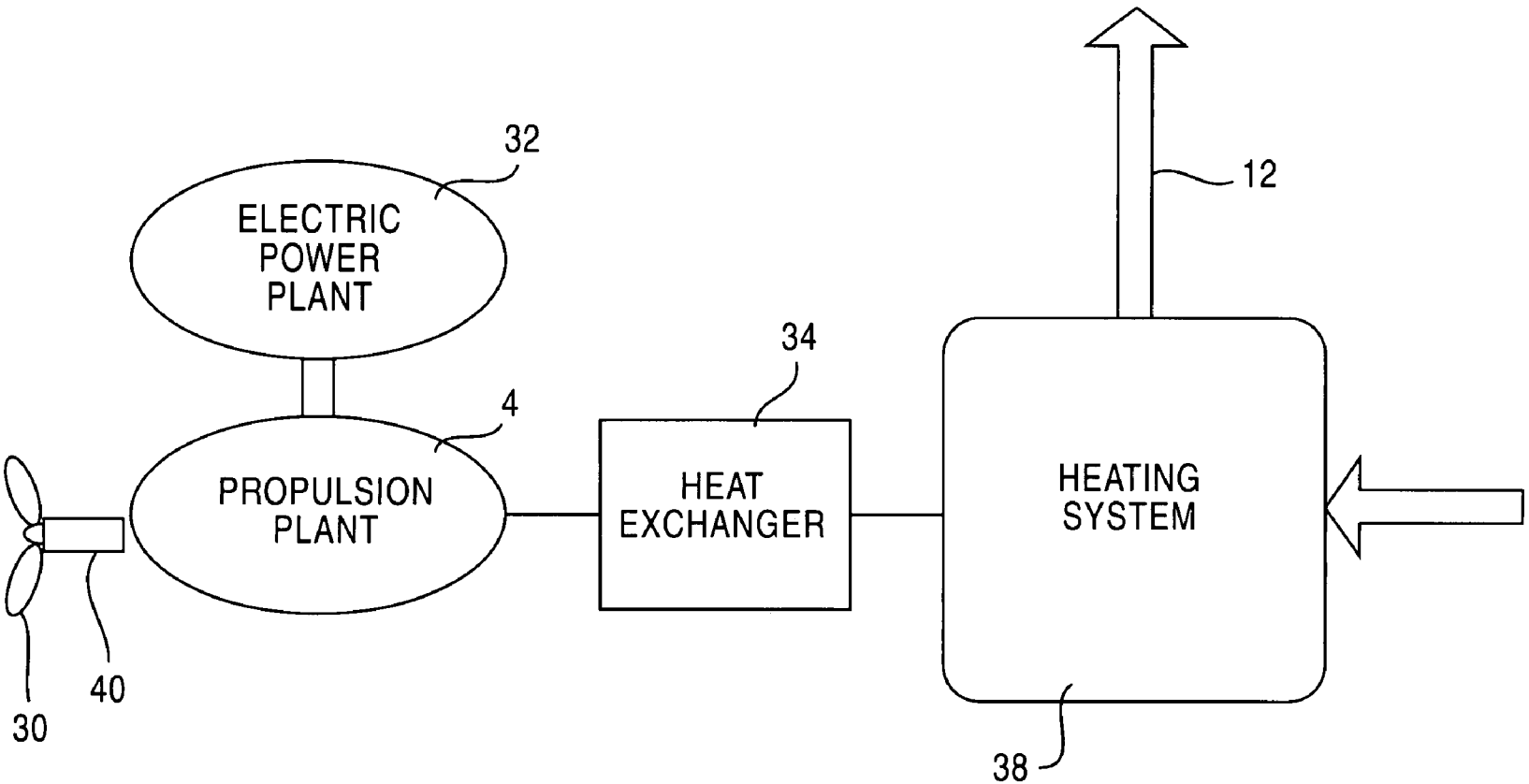
FIG. 5 illustrates the propulsion system interface with the hot water heating system according to the present invention.

A gas turbine or diesel engine propulsion plant forms propulsion plant 4 and can provide direct mechanical drive to the propeller shaft 40 and propeller 30 of the ship. Alternatively, propulsion plant 4 can be fitted with an integrated electric power plant 32, as illustrated in FIG. 5, using an electric motor or motors to drive the propeller shaft 40 and propeller 30. When the integrated electric power plant 32 powers the ship, the heat or energy generated may not be sufficient to achieve a desired regasification rate, so supplemental energy from other sources may be necessary. This supplemental energy may be obtained, for example, with an electric heating arrangement 36 as shown in FIG. 2. The electric heating arrangement 36 can be added to the ship to provide a readily available heat source for shipboard regasification. Thus, the heat or energy generated by the integrated electric power plant 32 can be supplemented by the electric heating arrangement 36 in order to achieve a desired regasification rate. In one embodiment of the present invention, the shipboard regasification plant can have a desired regasification rate or nominal sendout capacity of 450 million cubic feet per day (450-mmscf/d), which necessitates a heat input of approximately 260 million British Thermal Units per hour. This heat quantity can be achieved in the gas turbine or diesel engine propulsion plant by the electric heating arrangement.

Figure 3:
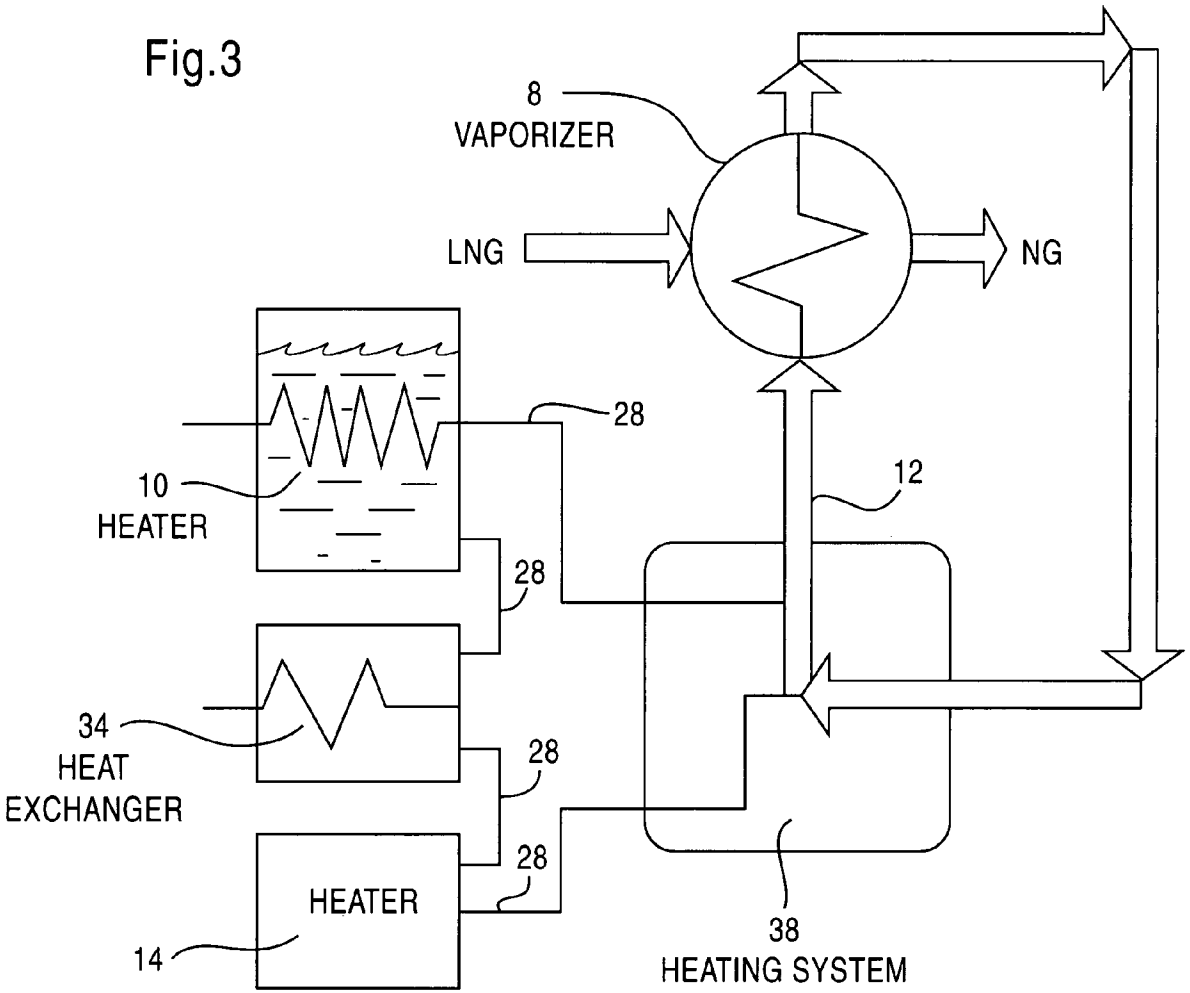
FIG. 3 illustrates a shipboard regasification system hot water heating system according to the present invention.

Referring to FIG. 3, the electric heating arrangement 36 can be a hot water heating system having a heat input source. The heat input source includes, for example, a combination of exhaust gas heat exchangers 34, electric water heaters 10, and supplemental heaters 14. Each of the exhaust gas heat exchangers 34, electric water heaters 10, and supplemental heaters 14 can directly heat the hot water circulating loop 12 of the hot water heating system 38. The hot water circulating loop 12 in turn, provides heat to a vaporizer or heat exchanger 8 to regasify the liquefied natural gas. As a result, the hot water heating system 38 becomes the primary source of heat for regasification of the liquefied natural gas. When the liquefied natural gas enters the vaporizer or heat exchanger 8 it comes into contact with the hot water circulating loop 12, and the heat from the circulating loop regasifies the liquefied natural gas. The combination of the exhaust gas heat exchangers 34, the electric water heaters 10 and the supplemental heaters 14 in the hot water heating system can be sized to provide the desired heat input for a shipboard regasification plant.

The exhaust gas, or waste heat exchangers 34 are mounted in the exhaust gas uptake from either the main diesel engines or gas turbines. Generally, the recovered heat from the exhaust gas heat exchanger 34 can be used to provide heat for various shipboard services such as fuel oil heating, accommodation heating, and cargo tank heating. For example, in a liquefied natural gas carrier with a 35,000 horsepower propulsion system plus shipboard electrical power demands, it is expected that approximately 80 million BTU/hr will be derived from the exhaust gas heat exchangers, with at least one heat exchanger fitted in the exhaust gas uptake of each diesel engine or gas turbine.

The electric water heaters 10 can be powered from the integrated electric power plant 32 and configured to directly heat the hot water circulating loop 12 in the hot water heating system 38. Submerged electric heating elements in storage hot water tanks heat the water in the electric water heaters. The hot water from the electric water heaters 10 can then be channeled to the circulating loop 12 by connecting line 28. For liquefied natural gas carrier with a 35,000 horsepower propulsion system plus shipboard electrical power demands, it is expected that approximately 100 million BTU/hr will be derived from electric water heaters.

Figure 4:
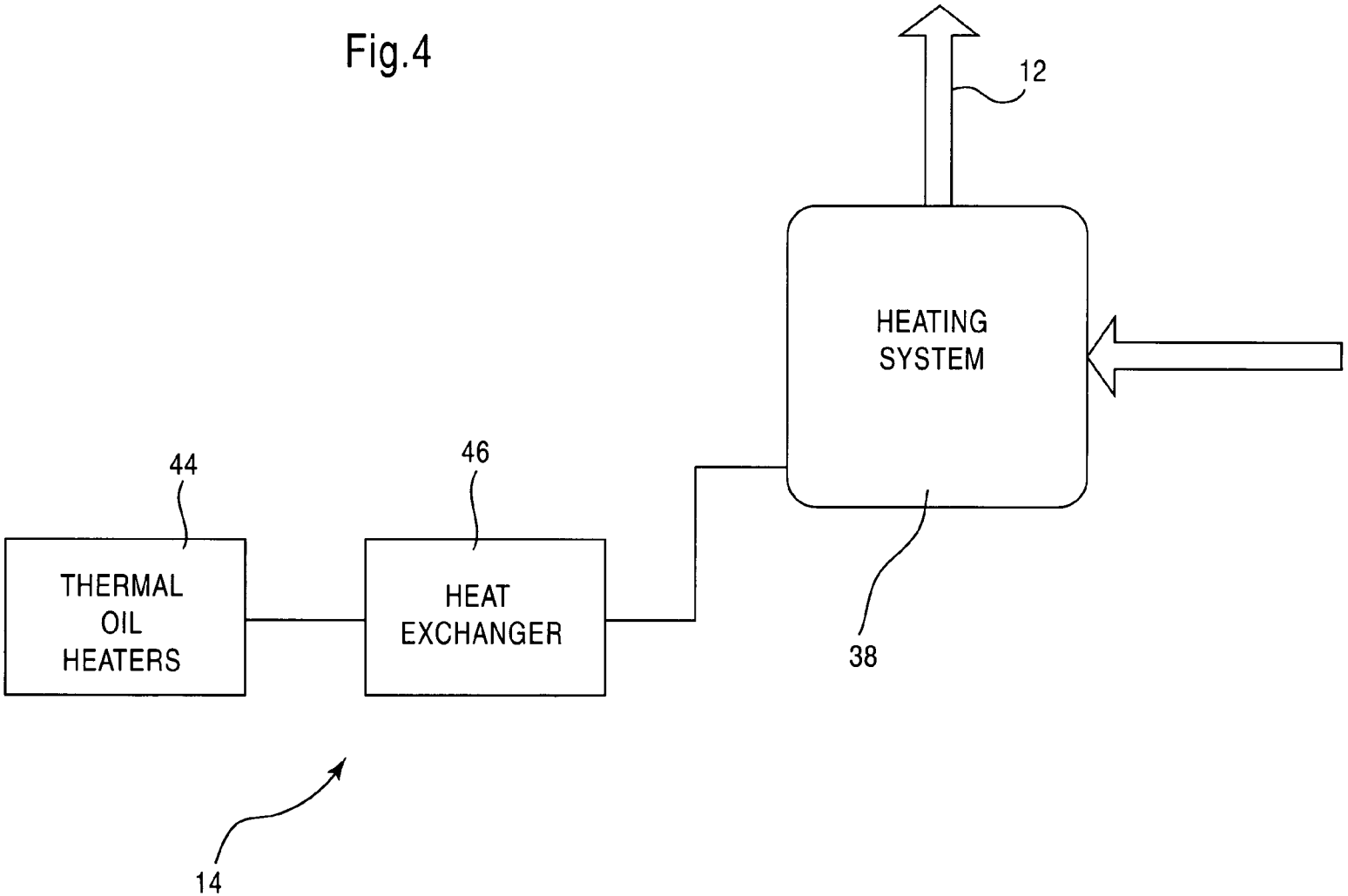
FIG. 4 illustrates one embodiment of the supplemental heater interface with the hot water heating system according to the present invention.

The supplemental heaters 14 can be natural gas fired hot water heaters 42 that provide the hot water heating system 38 with a supplemental heat input in order for the shipboard regasification system to achieve a desired nominal sendout rate. Thermal oil heaters 44, shown in FIG. 4 can also be used to supplement the heat input necessary to achieve a desired nominal sendout rate for shipboard regasification. If a thermal oil heater 44 is used as a supplemental heater, however, an additional thermal oil to hot water heat exchanger 46 or other transitional member must be mounted in the system to transfer heat from the thermal oil to the hot water heating system 38. A sendout rate of regasification of 450-mmscf/d, for example, will generally necessitate that the natural gas fired hot water heater be sized to provide approximately 80 million BTU/hr heat input. Natural gas fired hot water heaters and thermal oil heaters are commercially available products with ratings of approximately 20 million BTU/hr per unit. Therefore, in order to provide approximately 80 million Btu/hr of heat input to the circulating loop of the hot water heating system, four (4) supplemental heaters would be installed.

During regasification, the ship or vessel which functions as the liquefied natural gas carrier is typically anchored or moored to a buoy 26 offshore, at which time, the propulsion plant 4 is not operating to propel the ship 2, but to generate heat or electrical power. As a result, the propulsion plant 4 also exhausts waste heat. The waste heat passes through the exhaust gas heat exchangers 34 mounted in the exhaust gas uptake from either the main diesel engine or gas turbines, into a connecting line 28, in order to heat the hot water circulating loop 12 in the hot water heating system 38. The hot water heating system 38 also directly receives heat input from the electric water heater 10 through another connecting line 28. The natural gas fired hot water or thermal oil heaters 14 provide additional heat input to the circulating loop 12 of the hot water heating system 38 in order to achieve the desired nominal sendout rate for shipboard regasification. The circulating loop 12 in the hot water heating system carries water as the heated working fluid. The water in the hot water heating system can be heated to a temperature of about 100 to 150° F. by the combination of the exhaust gas heat exchangers 34, electric water heaters 10 and natural gas fired hot water or thermal oil heaters 14. Liquefied natural gas, which can be stored in a shipboard tank, can be brought into contact with the circulating loop 12, which causes the liquefied natural gas to gasify and to reach required minimum delivery temperature of approximately 40 F. Once the regasification process is performed, the gasified natural gas can be piped from the ship 2 through, for example, a submerged or undersea piping system 22 to an onshore plant 24 for subsequent distribution. Any acceptable piping system could be used. The gasified natural gas can be delivered into the piping system at a temperature of about 45–50° F.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

I claim:

1. A shipboard regasification system, comprising:

a vaporizing unit positioned on the ship, wherein the vaporizing unit is configured to vaporize a liquefied gas and wherein the vaporizing unit is coupled to a heating medium circulating loop;

a heat-generating propulsion unit on the ship that provides a source of heat to the heating medium circulating loop;

one or more additional sources of heat that provide heat to the heating medium circulating loop; and a conduit configured to carry vapor produce by heating the liquefied gas in the vaporization unit from the ship to a remote location.

2. The regasification system according to claim 1, wherein the propulsion unit comprises a gas turbine or diesel engine propulsion plant having an integrated electric power plant with an electric motor or motors to drive a propeller shaft(s) and a propeller(s).

3. The regasification system according to claim 1, wherein the propulsion unit is a gas turbine or a diesel engine propulsion plant having a direct mechanical drive operating a propeller shaft(s) and a propeller(s).

4. The regasification system according to claim 1, wherein the heating arrangement comprises a hot water heating, glycol heating, or similar fluid heating system.

5. The regasification system according to claim 1, wherein at least one of the additional sources of heat is powered by at least the propulsion unit, wherein the propulsion unit comprises a diesel engine or gas turbine propulsion plant having an integrated electric power plant.

6. The regasification system according to claim 1, wherein at least one of the additional sources of heat comprises an exhaust gas heat exchanger, an electric water heater, and a supplemental heater.

7. The regasification system according to claim 1, wherein at least one of the additional sources of heat comprises an electric water or heating fluid heater, and wherein the electric water heater or the heating fluid heater is powered by a diesel engine or gas turbine propulsion plant having an integrated electric power plant.

8. The regasification system according to claim 1, wherein the heat propulsion unit is coupled to an exhaust gas heat exchanger, wherein the exhaust gas heat exchanger captures waste heat from the diesel engine or gas turbine propulsion plant and transfers the heat to the heating medium circulating loop.

9. The regasification system according to claim 1, wherein at least one of the additional sources of heat comprises one or more supplemental heaters, wherein at least one of the supplemental heater comprises a natural gas fired hot water or heating medium heater, and wherein the supplemental heater supplements heat provided by at least one of the other additional sources of heat.

10. The regasification system according to claim 9, wherein the supplemental heater comprises a thermal oil heater and a linking member.

11. The regasification system according to claim 10, wherein the linking member comprises a thermal oil to hot water or heating medium heat exchanger that transfers heat from the thermal oil to the heating medium circulating loop.

12. The regasification system according to claim 1, wherein the liquefied gas comprises liquefied natural gas.

13. A method of regasifying liquid gas on board a ship, the method comprising:

generating heat from at a heat-generating propulsion unit of the ship;

transporting the generated heat from the heat-generating propulsion unit of the ship through a heating medium circulating loop to a regasifying member on the ship;

providing additional heat from one or more additional sources of heat to heating medium circulating loop;

conveying a liquefied gas through the regasifying member;

regasifying the liquefied gas into a vaporized gas in the regasifying member; and transporting the vaporized gas to a remote location off of the ship.

14. The method of claim 13, wherein transporting the generated from the heat-generating propulsion unit of the ship comprises transferring heat from an exhaust gas heat exchanger coupled to the heat-generating propulsion unit and the heating medium circulating loop.

15. The method of claim 13, wherein providing heat from at least one of the additional heat sources comprises transferring heat from an electric water or fluid heater to the regasifying member.

16. The method of claim 13, further comprising:

generating supplemental heat in a supplemental heating unit;

transporting the supplemental heat to the heating medium circulating loop; and providing the supplemental heat from the heating medium circulating loop to the regasifying member.

17. The method of claim 13, wherein the propulsion unit of the ship comprises a diesel engine or gas turbine propulsion plant.

18. The method of claim 13, wherein regasifying the liquefied gas comprises providing heat to the liquefied gas through a heat exchanger or vaporizer.

19. The method of claim 13, wherein regasifying a liquefied gas comprises regasifying a liquefied natural gas.

20. The method of claim 13, wherein transporting the vaporized gas comprises transporting the vaporized gas through a piping system to a remote location.

21. A shipboard regasification heat input system, comprising:

generating means for generating heat on a ship, wherein the generating means comprises a propulsion unit of the ship;

carrying means for carrying the generated heat to a heating circulating loop;

transferring means for transferring additional heat from one or more additional sources of heat to the heating medium circulating loop;

transferring means for transferring heat from the heating medium circulating loop to a regasifying means;

regasifying means for regasifying a liquefied gas into a gas vapor; and transporting means for transporting the gas vapor to a remote location off of the ship.

* * * * *

UNITED STATES PATENT AND TRADEMARK OFFICE

CERTIFICATE OF CORRECTION

PATENT NO. : 7,219,502 B2
APPLICATION NO. : 10/916625
DATED : May 22, 2007
INVENTOR(S) : Alan Nierenberg It is certified that error appears in the above-identified patent and that said Letters Patent is hereby corrected as shown below:

Claim 1, col. 5, line 44, please delete "produce" and substitute therefor --"produced"--.

Claim 4, col. 5, line 57, please delete "arrangement" and substitute therefor --"medium circulative loop"--.

Signed and Sealed this

Seventh Day of August, 2007

JON W. DUDAS
*Director of the United States Patent and Trademark Office*